United States Patent [19]

Wescott

[11] Patent Number: 4,820,161

[45] Date of Patent: Apr. 11, 1989

[54] TRAINING AID

[75] Inventor: Peter L. Wescott, Kingsbury Episcopi, England

[73] Assignee: Westland System Assessment, Ltd., Somerset, England

[21] Appl. No.: 89,991

[22] Filed: Aug. 27, 1987

[30] Foreign Application Priority Data

Sep. 3, 1986 [GB] United Kingdom ..... 8621272

[51] Int. Cl.[4] ..... F41G 11/00

[52] U.S. Cl. ..... 434/16; 434/19

[58] Field of Search ..... 434/16, 17, 19, 38, 434/43, 44

[56] References Cited

U.S. PATENT DOCUMENTS 3,608,212 9/1971 Lenneryd et al. ..... 434/17

3,742,618 7/1973 Entwistle ..... 434/17

FOREIGN PATENT DOCUMENTS 2030685A 8/1979 United Kingdom .

*Primary Examiner*—Leo P. Picard

*Attorney, Agent, or Firm*—Larson and Taylor

[57] ABSTRACT

A method and apparatus for simulating artillery and other types of indirect field of fire gunnery as an aid to training gunnery observers comprises projecting onto a screen 11 a terrain photographic image. Computer generated artillery shell bursts are overlaid on the terrain photographic image at locations commanded by a trainee observer 19 by projection through a video projector 14 connected with a computer 15. Instructions are entered in the computer by an operator 17 who may be a training instructor.

3 Claims, 1 Drawing Sheet

TRAINING AID

BACKGROUND OF THE INVENTION

1. Field of the Invention

This invention relates to training aids and is more particularly concerned with a method and an apparatus for training observers of artillery and other types of indirect field of fire gunnery.

2. Description of the Prior Art

A known training aid, called a 'Puff Range', for simulating artillery fire comprises a hessian model of an actual section of terrain. The hessian is stretched over a framework and painted so as to represent topographical features such as hills, roads, rivers and woods which coincide accurately with a relevant ordnance survey map of the area. The hessian model is supported above a ground surface at a height sufficient for an operator to walk beneath it and the ground surface is painted with grid lines corresponding with those of the map area represented. The impact of a shell is represented at the grid reference ordered by an observer by the operator moving a smoke generating device to the grid reference beneath the model and causing a puff of smoke to be emitted through the hessian.

Whilst this training aid is effective in teaching observers it has disadvantages in that it is a static equipment which occupies a considerable space envelope, and it lacks flexibility in training because the terrain represented cannot easily be changed so that with use target location becomes too easy.

U.S. Pat. No. 3,608,212 discloses a simulator for artillery fire controller trainees (i.e. observers) in which a panorama of a battlefield is projected onto a screen in front of a trainee by means of a projector. Burst images simulating artillery rounds fired at a target are projected on the panorama picture by a mechanically movable burst image projector. The burst image projector is adjustable in azimuth and elevation so as to project a burst image on the panorama picture at a grid reference location commanded by the trainee. The mechanical movement of the burst image projector makes the simulator apparatus cumbersome both for installation and use.

There is a requirement for a low cost artillery observer training aid which is simple in operation whilst providing a selection of landscape views and not having a requirement for continuous occupation of a large space envelope.

SUMMARY OF THE INVENTION

Therefore, one object of the present invention is to provide a method of training artillery observers which meets the aforesaid requirement.

Another object of the invention is to provide low cost, compact, easily movable apparatus for training artillery observers.

In achieving the first object, the invention provides a method of simulating artillery fire for training an artillery observer comprising the steps of projecting a computer generated line frame on a projection screen through a video projector, projecting on the screen a terrain photographic image so that the boundaries thereof are aligned with the boundaries of the line frame, entering in a memory of the computer the grid co-ordinates and height above sea level of the location at which the photographic image was taken, entering in the computer memory the grid co-ordinates of at least two locations marked on the projected terrain photographic image by cross-hair cursor lines drawn by the computer and projected through the video projector, entering in the computer grid co-ordinates of a target location commanded by a trainee observer positioned to observe the projection screen, computing the corresponding position of the target location on the projected terrain photographic image, overlaying on the projected terrain photographic image at said corresponding position a computer generated artillery shell burst image by projection through the video projector.

In realisation of the second object, the invention provides an artillery observer training aid apparatus comprising a projection screen, a projector for projecting on the projection screen a photographic image of a terrain in which artillery fire is to be simulated, a video projector for overlaying computer generated artillery shell burst images on the terrain photographic image, a computer adapted for connection with the video projector, a computer operator keyboard for entering instructions in the computer, a computer operator monitor screen for displaying instructions entered in the computer and output by the computer, a computer memory for storing grid co-ordinates and height above sea level of the location at which the projected terrain photographic image was taken and grid co-ordinates of at least two locations marked on the projected terrain photographic image by computer generated cross-hair cursor lines projected through the video projector, a computer program for computing the position of a target location on the projected terrain photographic image corresponding to grid co-ordinates entered in the computer at the command of a trainee observer, the computer program generating an artillery shell burst image which is overlaid on the projected terrain photographic image at the computed position by projection through the video projector.

It should be appreciated that the term "artillery" when used herein is not limiting and extends to all types of indirect field of fire gunnery such as mortars.

Vocal commands from the trainee observer as to the grid co-ordinates of the target to be engaged, distribution of fire, method of engagement and method of fire are received by the operator and input to the computer for computation by the computer program to produce signals which are passed to the video projector so that images simulating artillery shell explosive bursts of a pattern determined by the ammunition type and number of rounds specified appear on the projection screen at the specified grid reference.

In addition to artillery shell explosive bursts, target images such as, for example, buildings or vehicles, may be overlaid on the photographic terrain image, such target images being projected on the projection screen by the video projector in accordance with signals received from the computer in response to instructions input by the computer operator.

As an aid to assisting the trainee observer in positioning himself in front of the projection screen the computer program may be adapted to mark graduation lines at suitably spaced intervals across the centre of the projection screen so that by looking through binoculars having suitable graticules and taking up a position in which the binocular graticules match up to the graduations on the projection screen the observer is able to accurately position himself.

Various initial values for simulation parameters may be input to the computer such as location of fire battery, number and distribution of guns, lost round simulation, size and persistence of burst symbol, round inaccuracy factors, and target type/location.

Input of these simulation parameters may be at the discretion of a training instructor who may, if desired, be the computer operator.

Provision may be made for simulation of sound effects such as artillery shell flight and explosive burst.

The trainee observer may communicate commands to the computer operator for entry in the computer detailing information as to the location to be engaged, the distribution of fire, the method of engagement and the method of fire.

BRIEF DESCRIPTION OF THE DRAWINGS

The invention will now be further described by way of example only and with reference to the accompanying drawings, in which.

DETAILED DESCRIPTION OF THE INVENTION

Figure 1:
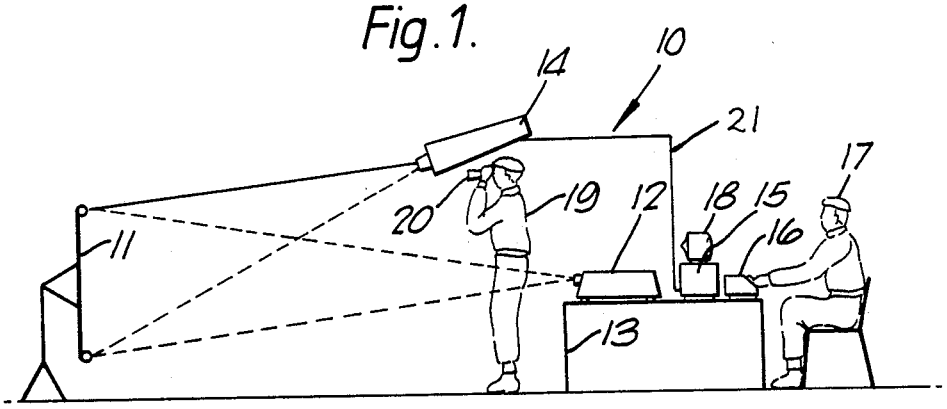
FIG. 1 is a diagrammatic side view of apparatus in accordance with one embodiment of the invention.
Figure 2:
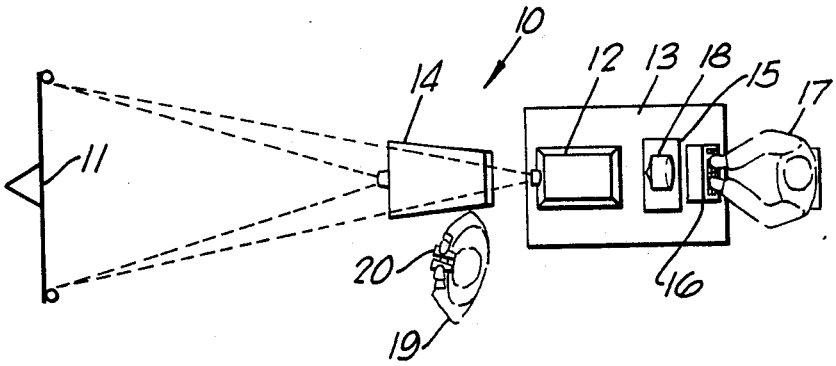
FIG. 2 is a diagrammatic plan view of the apparatus shown in FIG. 1.

Referring to the drawings, an artillery observer training aid apparatus 10 comprises a stand mounted projection screen 11 suitably positioned in front of a carousel slide projector 12 supported on a table 13. A video projector 14 is suitably mounted in an overhead position for projecting images onto the screen 11 although, if desired, it may be floor mounted. Supported on the table 13 is a microcomputer 15 having a memory and a single floppy disc drive for holding an operating program. A keyboard 16 is connected to the computer for input of alphanumeric commands and instructions by a computer operator 17. A monitor screen 18 is connected to the computer for facilitating observation by the operator of instructions entered in and output by the computer as well as computer generated artillery shell burst images. A trainee artillery observer 19 takes up position in front of and to one side of the projector 12, and observes the screen 11 through graticuled binoculars 20.

The video projector 14 is connected by signal line 21 (FIG. 1) to the computer 15 whereby the projector is caused to project, on command, computer generated artillery shell burst images.

For the purposes of this embodiment the computer operator will be considered to be a training instructor although this need not be the case.

A computer program, written in interpreted BASIC and provided on a floppy disc, is loaded into the computer and performs the functions of calibration of photographic and computer generated images, simulation control command interpretation, fire command interpretation, and calculation and display of explosive burst and target positions.

The first of these functions, calibration of photographic and computer generated images, is the most complex and critical aspect of the program because if it is not correctly carried out the computer generated images will not appear at the correct location on the projected photographic image of the chosen terrain. This setting up involves the following procedures:

a. The computer program is started up and draws on the projection screen a line frame in the shape of a rectangle of aspect ratio corresponding to the slide type projected on the screen and to the lateral limits of the computer display. The slide projector is then aligned so that the centre of a projected terrain photographic image corresponds, substantially, with the centre of the line frame and the sides of the projected photographic image are aligned as far as possible with the sides of the line frame. When this has been achieved the line frame is removed from the projection screen display.

b. The computer then requests the grid co-ordinates and the height above sea level of the location at which the photograph of the terrain was taken. If not known specifically this information is deduced from an ordnance survey map of the area and entered in the computer memory. This is the only information required about the photograph itself and it is assumed that the camera position equates directly with the observer position.

c. After entry of this information the computer draws a cross hair cursor that is projected on the projection screen display and which can be moved around anywhere within the limits of the computer display. The operator is asked by the computer to move the cursor to a point on the projected photographic image whose position is known or can be deduced directly from the ordnance survey map. If the chosen feature is tall then the bottom of the feature is marked. The grid position and height above sea level of the feature is then entered in the computer memory.

This procedure is performed for at least two separate points on the projected photographic image which should be well separated both vertically and horizontally in order to make the calibration as accurate as possible.

d. The computer program then calculates the factors required to convert any entered grid position to its corresponding position on the projection screen display.

e. So as to be able to use the graticules within his binoculars correctly the observer takes up a fixed position in front of the projection screen. In order to accurately set this position the computer will optionally at this stage mark on the projection screen graduation lines at intervals of 10 milliradians across the screen centre. By looking through his binoculars and taking up a position in which the graticules in his binoculars match up to the graduations on the screen the observer is able to accurately position himself. The graduation lines are then removed from the screen and the calibration is complete.

The marking on the screen by the computer of the graduation lines is optional because these may not be required if a slide has been used previously and the position for that projected photographic image is known.

The next function performed by the computer program is that of simulation control command interpretation. The computer program requests by display on the monitor screen that various initial values for simulation parameters be input. These are changeable at any stage during a training mission on input of a simple code. The control commands accepted are as follows:

a. Location of fire battery. Although the operator is not required to convert the fire commands from the observer according to his notional location, it is necessary to enter this position in order to allow across or along track errors in the burst position to be calculated.

b. Number and distribution of guns. If not entered a default is assumed.

c. Sound effects on/off. This determines whether sound effects are simulated during artillery shell flight and explosive burst impact if provision is made for simulation of sound effects.

d. 'Lost' round simulation. The training instructor is able to decide that lost rounds will occur randomly with a given probability or, alternatively, may decide before each round is fired whether it is lost. A lost round is indicated by the non-appearance of a burst after a round is fired.

e. Size and persistence of burst symbol. As a facility for the training instructor in instructing his trainee observer the size of the burst appearing on the projection screen is selectable from a range, e.g. 'large', 'medium', 'small'. The actual size of a burst symbol is dependent upon its distance from the observer as well as the burst size specified by the training instructor. The persistence is the time the symbol remains on the projection screen and is selectable by the training instructor.

f. Round inaccuracy factor. The training instructor is able to decide whether each round shall have a random cross track and/or long track error according to a predetermined distribution or, alternatively, he may set a fixed error for an individual round.

g. Target type/location. Fixed position foreground targets can be overlaid on the projection screen or removed at any stage, at the discretion of the training instructor, either by specifying the grid co-ordinates or by specifying a position with a cross hair cursor.

The next function performed by the computer program, that of firing command interpretation, allows the following commands communicated by the observer to be entered by the operator before each round is fired and simulated on the screen:

a. Location to engage. This is entered either as grid co-ordinates or as a range and bearing or as an adjustment from the previous location (left/right, add/drop and distance).

b. Distribution of fire. Either 'converge' or parallel'.

c. Method of Engagement. High explosive rounds are assumed if this is not entered. Proximity fuze and smoke rounds are also allowed.

d. Method of fire. This determines when a round is to be released. A fire order can be immediate or after a given delay. If fire for effect is required, then the number of guns, number of rounds per gun, and the rate of fire are entered.

The final function to be performed by the computer program is that of calculation and display of explosive bursts. The computer program facilitates the following processing to be performed by the computer:

a. According to the position or offset location input by the computer operator on instructions received from the trainee observer, and the fuze type, the program calculates the point on the projection screen at which the burst will occur.

b. According to the distance of the burst from the observer both the delay until the burst is shown and the size of the displayed burst is calculated. Appropriate sound effects may be generated during the trajectory and on impact.

c. If a burst position error is demanded or generated then this is added to the position.

d. If a 'lost' round is flagged then the burst will not be shown, though any required trajectory sound effects will still occur.

e. According to the input persistence time for the burst, the displayed effect is removed after that interval.

In operation of training aid apparatus in accordance with this embodiment of the invention, after calibration of the photographic and computer generated images as hereinbefore described, and with a terrain photographic image being projected on the screen 11 by the projector 12, the training instructor inputs into the computer such of those simulation control commands as he may decide and designates a target for the trainee observer. The trainee observer identifies the target, using his binoculars if desired. Having determined the grid co-ordinates of the target position from his ordnance survey map, he communicates these co-ordinates, together with other firing commands, to the computer operator by vocal commands. These instructions are input to the computer and computed with the control commands previously input by the training instructor. The video projector is then signalled (by way of signal line 21), to project on the projection screen, at a position on the terrain photographic image corresponding to the co-ordinates communicated by the observer, shell burst images of a pattern and size dependent upon the other instructions and commands input to the computer.

The observer observes the position of these bursts, uses his graticuled binoculars to determine any necessary correction, and communicates adjustments to the computer operator for input to the computer. Thereafter the computer signals the video projector to project appropriate shell burst images at the new position.

Because the signal output by the computer is passed to both the monitor screen 18 and the video projector 14, the text of all instructions input to the computer by the operator and output by the computer program will be displayed on the screen 11 as well as on the monitor screen 18. To avoid confusing the trainee observer and aid his concentration on the projected terrain photographic image, the displayed text is arranged to appear outside the limits of the projected terrain photographic image. Also, a dark blue colour is arranged to be specified by the computer in displaying the text, which colour will be less visible on the projection screen 11 but which by use of a suitable monochrome monitor screen 18 will appear as a light colour on the monitor screen.

The method of the present invention facilitates provision of low cost training aid apparatus providing for selection of different terrain images and which can be housed in a room having a floor area of approximately 20 feet by 12 feet (6 meters by 3.6 meters) with the capability of being readily removed if the room is required to be used for other purposes.

What is claimed is:

1. A method of simulating artillery fire for training an artillery observer comprising the steps of:

a. projecting a computer generated line frame on a projection screen through a video projector, b. projecting on the projection screen a terrain photographic image so that the boundaries thereof are aligned with the boundaries of the line frame, c. entering ion a memory of the computer the grid co-ordinates and height above sea level of the location at which the photographic image was taken, d. entering in the computer memory the grid co-ordinates of at least two locations marked on the projected terrain photographic image by cross-hair cursor lines drawn by the computer and projected through the video projector, e. entering in the computer grid co-ordinates of a target location commanded by a trainee observer positioned to observe the projection screen, f. calculating in the computer from the information stored therein by steps c, d, and e the corresponding position of the target location on the projected terrain photographic image, g. overlaying on the projected terrain photographic image at said corresponding position a computer generated artillery shell burst image by projection through the video projector.

2. A method according to claim 1 including the step of overlaying on the terrain photographic image a computer generated target image by projection through the video projector.

3. A method according to claim 1 including the step of projecting on the projection screen through the video projector computer generated graduation lines at spaced intervals across the projection screen for assisting a trainee observer observing the projection screen through graticuled binoculars to take up an accurate position in front of the projection screen.

* * * * *